United States Patent [19]

Englert et al.

[11] 3,965,221

[45] June 22, 1976

[54] FLUID FLOW DEVICE AND LIQUID METERING

[75] Inventors: Robert D. Englert, Corona Del Mar; Lester Porter Berriman, Irvine; Kenneth P. Armstrong, Lakewood, all of Calif.; Douglas A. Roe, Gilbert, Ariz.

[73] Assignee: Dresser Industries, Inc., Dallas, Tex.

[22] Filed: July 3, 1974

[21] Appl. No.: 485,518

[52] U.S. Cl. ..... 261/23 A; 261/39 A; 261/44 R; 261/36 A; 261/DIG. 38; 261/DIG. 56; 261/DIG. 60; 261/DIG. 78

[51] Int. Cl.[2] ..... F02M 7/20

[58] Field of Search..... 261/DIG. 78, 39 A, 36 A, 261/23 A, DIG. 38, DIG. 56, DIG. 60, 44 R

[56] References Cited

UNITED STATES PATENTS

| | | | |
|---|---|---|---|
| 1,793,148 | 2/1931 | Warlay | 261/DIG. 56 |
| 2,052,225 | 8/1936 | Hartshorn | 261/DIG. 56 |
| 2,468,416 | 4/1949 | Reuter | 261/39 A |
| 2,509,994 | 5/1950 | Reuter | 261/39 A |
| 2,611,595 | 9/1952 | Streed | 261/39 A |
| 2,672,329 | 3/1954 | Zarnack | 261/DIG. 56 |
| 3,778,038 | 12/1973 | Eversole et al. | 261/DIG. 78 |
| 3,794,302 | 2/1974 | Diener | 261/36 A |
| 3,807,710 | 4/1974 | Bergamini | 261/39 A |
| 3,829,069 | 8/1974 | Hailstone et al. | 261/DIG. 78 |
| 3,887,662 | 6/1975 | Gural et al. | 261/39 A |

*Primary Examiner*—Tim R. Miles
*Attorney, Agent, or Firm*—Connolly and Hutz

[57] ABSTRACT

A combustible air-liquid fuel mixture having a substantially constant air-to-fuel ratio is produced for delivery to the intake manifold of an engine. Air is passed through a fluid flow device having a variable area throat zone to increase the velocity of the air to sonic, and the area of the throat zone is varied in correlation with operating demands imposed upon the engine for which the mixture is produced. Liquid fuel is metered from a supply into the air stream at or before the throat zone in direct proportion to the cross-sectional area of the throat zone. The pressure of the high velocity air stream is sensed at a point where it bears a predictable relationship to atmospheric pressure, and the rate of fuel delivered into the air stream is adjusted in response to changes in the air pressure sensed so that the air-to-fuel ratio of the mixture is maintained substantially constant. Due to the particular design of the fluid flow device, air at sonic velocity passes through the throat zone over substantially the entire operating range of the engine down to low manifold vacuum levels. During the relatively brief subsonic mode of operation when the manifold vacuum levels are quite low, the fluid flow device functions as a metering venturi to introduce the liquid fuel into the varying velocity air stream.

15 Claims, 22 Drawing Figures

Air
To Throttle

FLUID FLOW DEVICE AND LIQUID METERING

CROSS-REFERENCE TO RELATED APPLICATION

The present application is related to an application entitled "Fluid Flow Regulation", filed July 3, 1974 and given Ser. No. 485,517.

BACKGROUND OF THE INVENTION

The present invention relates to a fluid flow device and liquid metering, and more particularly to a method and apparatus for producing a combustible air-liquid fuel mixture having a substantially constant air-to-fuel ratio.

U.S. Pat. No. 3,778,038, granted Dec. 11, 1973, explains a method and apparatus for producing a uniform combustible mixture of air and minute liquid fuel droplets for delivery to the intake manifold of an engine. The apparatus includes an intake air zone connected to a variable area throat zone for constricting the flow of air to increase its velocity to sonic. Liquid fuel is introduced into the air stream at or before the throat zone to minutely divide and uniformly entrain fuel as droplets in the air flowing through the throat zone. Walls downstream of the throat zone are arranged to provide a gradually increasing cross-sectional area for efficiently converting a substantial portion of the kinetic energy of the high velocity air and fuel to static pressure. Such conversion enables the maintenance of sonic velocity air through the throat zone over substantially the entire operating range of the engine to which the air-liquid fuel mixture is supplied.

The above U.S. patent further explains the well known phenomena that under sonic conditions, the pressure of the air stream at the throat zone is approximately 53% of atmospheric pressure. Under sonic conditions and when the atmospheric pressure remains constant, it is possible to provide an air-liquid fuel mixture having a substantially constant air-to-fuel ratio by simply metering the rate of fuel delivered into the air stream in direct proportion to the area of the throat zone. However, when atmospheric pressure varies, possibly due to altitude changes, the mass rate of air flowing through the apparatus also varies. Also, atmospheric temperature conditions have a bearing upon the mass rate of air flowing through the apparatus. When these atmospheric changes occur it is necessary to adjust the rate of fuel introduced into the high velocity air stream in order to maintain a substantially constant air-to-fuel ratio. For example, when atmospheric pressure decreases, the air passing through the apparatus is somewhat thinner and it has less mass density when compared to air at a higher pressure. Accordingly, less fuel is required to produce a mixture having the same air-to-fuel ratio as before the atmospheric presure change. A fuel metering system which relies solely upon the area of the throat zone or the volume of air passing therethrough does not adjust or otherwise correct for such atmospheric fluctuations, and the air-to-fuel ratio varies depending upon atmospheric conditions.

It is also desirable that the apparatus for producing the air-liquid fuel mixture be relatively insensitive during the critical idling mode of the engine for which the mixture is produced. In other words, the structure for varying the area of the throat zone should be capable of easily achieving such variation in very small increments. Drastic area changes during the idling mode result in equally drastic changes in the quality and quantity of the air-liquid fuel mixture produced. Moreover, the geometry of the apparatus must be such that the maximum air flow rate required by the engine is provided without adversely affecting efficient conversion of the kinetic energy of the high velocity air and fuel to static pressure. It is highly desirable to maintain sonic air flow at the throat zone over substantially the entire operating range of the engine, even when the engine requires its maximum volumetric air flow rate. Such criteria may require dual passageways, as explained below.

Finally, it is desirable to provide a relatively constant pressure signal for drawing fuel into the high velocity air stream while maintaining sonic flow at the throat zone over substantially the entire operating range of the engine. Constant vacuum carburetors of the type described in 1 Fisher, Carburation, 4th Ed. 1963 and Larew, Carburetors & Carburetion, 1967 attempt to provide a constant pressure signal for fuel introduction but these devices are complex and the velocity at the butterfly valve varies throughout most of the operating cycle of the engine.

SUMMARY OF THE INVENTION

Accordingly, an object of the present invention is a fluid flow device with liquid metering that operates in a simple and highly efficient manner to produce a uniform air-liquid fuel mixture over substantially the entire operating range of the engine to which the mixture is supplied.

Another object of the present invention is a simple and highly efficient method and apparatus for metering liquid fuel in a manner that compensates for changes in atmospheric conditions so that the air-to-fuel ratio of an air-liquid fuel mixture remains substantially constant.

In accordance with the present invention, a fluid flow device for producing a combustible air-liquid fuel mixture comprises walls that define at least one passageway. The passageway includes a gradually converging air entrance zone, a variable area throat zone through which air and liquid fuel are passed at sonic velocity, and a gradually diverging downstream zone. The wall structure includes a pair of spaced apart stationary large jaws opposite one another and a pair of opposite small members mounted for relative movement toward and away from one another to vary the area of the throat zone. Each of the opposite small members may be in the form of a small jaw having an angle of convergence in the upper portion of the air entrance zone, a flat portion extending therefrom to slightly below the throat zone, and a slight angle of divergence in the lower portion of the diffuser zone. Fuel is introduced into the passageway at or above the throat zone where these small jaws are flat.

Preferably, each of the large stationary jaws has an angle of divergence approximately 2° to 5° in the diffuser zone, and each of the small jaws has an angle of divergence approximately 0° to 2° in the diffuser zone. Also, the area ratio of the downstream end of the diffuser to the throat zone may be 1.3 to 20:1, and preferably 1.5 to 15:1. The above geometry enables the fluid flow device to function in a highly beneficial manner, and sonic air flow is maintained even at very low manifold vacuum levels.

Furthermore, method and apparatus are provided for producing a combustible air-liquid fuel mixture having a substantially constant air-to-fuel ratio. Air is passed through the variable area throat zone to increase its velocity to sonic, and the area of the throat zone is varied in correlation with operating demands imposed upon the engine for which the mixture is produced. The method and apparatus further include metering fuel from a supply into the air stream at or before the throat zone in direct proportion to the area thereof, and the pressure of the high velocity air stream is sensed at a point where it bears a predictable relationship to atmospheric pressure. Finally, the rate of fuel delivered into the air stream is adjusted in response to changes in the air pressure sensed so that the air-to-fuel ratio of the mixture is maintained substantially constant.

The pressure of the high velocity air stream may be sensed at the throat zone, or alternatively, such pressure may be sensed upstream from the throat zone. The pressure of the high velocity air upstream from the throat zone bears a predictable relationship to atmospheric pressure when the cross-sectional area ratio between the air entrance zone and the throat zone is constant, such pressure upstream from the throat zone is independent of the throat opening. Moreover, the present invention may include the method and structure for sensing atmospheric temperature, and adjusting the rate of fuel delivered into the air stream in response to changes in the temperature sensed.

As noted above, the pair of spaced apart opposite relatively movable members that define the flow passageway with the stationary large jaws may comprise a pair of small jaws. Alternatively, each of these members may be in the form of a slab. In either instance, the fuel delivery structure includes a fuel opening in one of the small members upstream from the throat zone, and the opening is connected to the fuel supply. A metering rod connected for movement with the other small member is received within the fuel opening so that the rod moves relative to the fuel opening to vary the cross-sectional area of the opening and the rate of fuel delivered as the area of the throat is varied by relative movement of the small members.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE INVENTION

Figures 1, 2, 3, 4, 5, 6, 7, 8, 9, 10, 11:
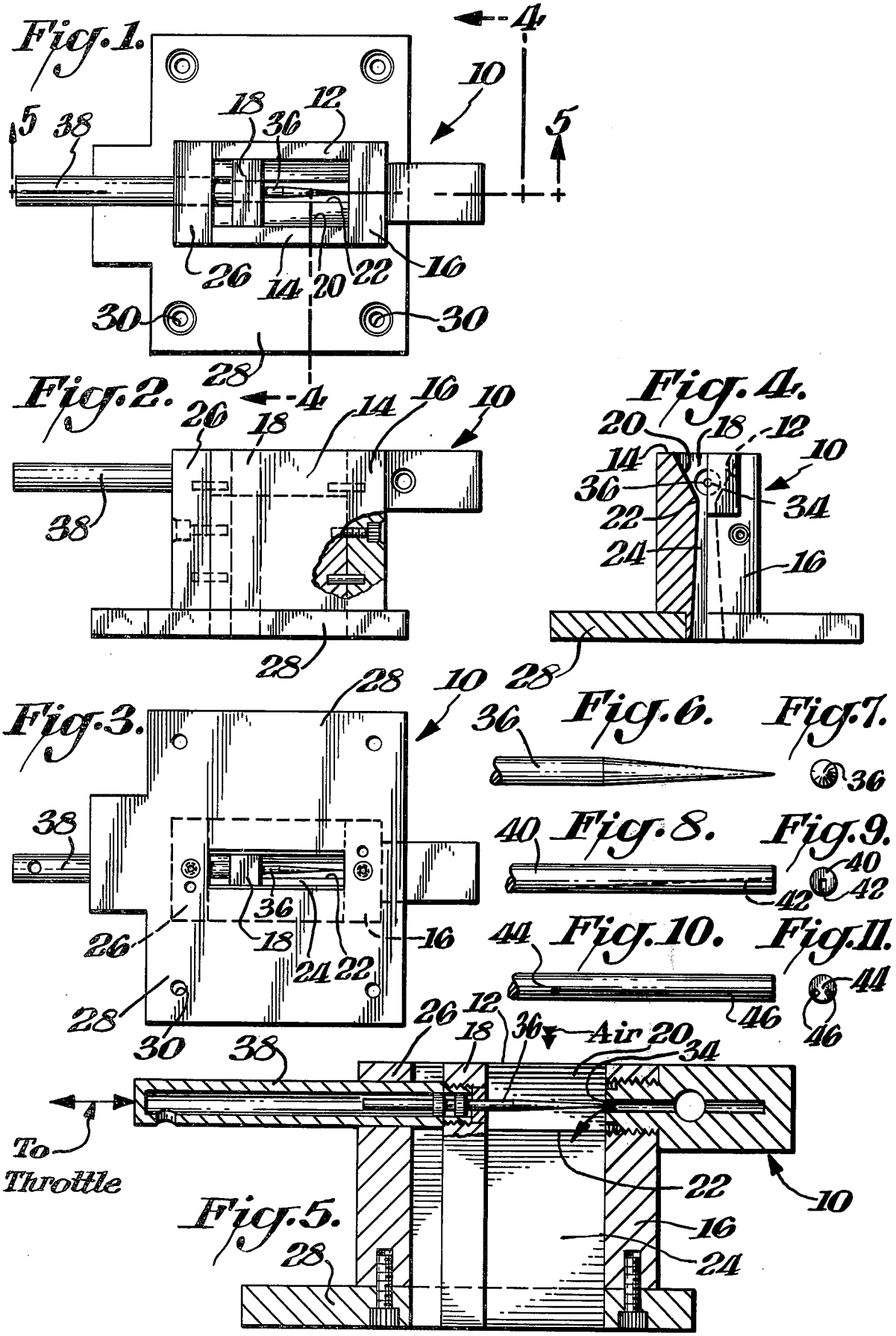
FIG. 1 is a top plan view of a fluid flow device, according to the present invention.
FIG. 2 is a side elevational view of the device shown in FIG. 1 with portions broken away to show interior detail.
FIG. 3 is a bottom plan view of the device shown in FIG. 1.
FIG. 4 is a sectional view taken along line 4—4 of FIG. 1.
FIG. 5 is a sectional view taken along line 5—5 of FIG. 1.
FIG. 6 is a side elevational view of a portion of a metering rod, according to the present invention.
FIG. 7 is an end elevational view of the metering rod of FIG. 6.
FIG. 8 is a side elevational view of another metering rod, according to the present invention.
FIG. 9 is an end elevational view of the metering rod of FIG. 8.
FIG. 10 is a side elevational view of still another metering rod, according to the present invention.
FIG. 11 is an end elevational view of the metering rod of FIG. 10.

Referring in more particularity to the drawings, FIGS. 1–5 illustrate a fluid flow device 10 for mixing and modulating liquid fuel and air in the production of a combustible air-liquid fuel mixture having a substantially constant air-to-fuel ratio. Generally, the device 10 comprises an elongated housing with a central flow passageway therein. The passageway is defined by a pair of opposite stationary large jaws 12, 14 and a pair of opposite small members in the form of slabs 16, 18. As explained more fully below, slab 18 moves toward and away from stationary slab 16 to vary the mass flow of air passing through the passageway. Specifically, the passageway includes a gradually converging air entrance zone 20, a variable area throat zone 22, and a gradually diverging downstream zone 24. The stationary jaws 12, 14 together with slab 16 and housing end wall 26 are secured to a rectangular base plate 28 having openings 30 therein for securing the device 10 to the intake manifold (not shown) of an internal combustion engine.

The inside walls of the opposite stationary large jaws are shaped to define a venturi cross section with the small slabs 16, 18 and this venturi cross section includes the air entrance zone 20, the throat zone 22, and the gradually diverging downstream zone 24. Atmospheric air enters the mixing and modulating device 10 at the air entrance zone 20, and the air is accelerated to sonic velocity at the throat zone 22. Liquid fuel is introduced into the high velocity air stream at a fuel opening 34 upstream from the throat 22. The fuel opening is located in the stationary slab 16, and a fuel source (not shown) is connected to the opening. A tapered fuel metering rod 36 mounted for movement with the movable slab 18 is received within the fuel opening 34 to vary the rate of fuel delivered into the high velocity air stream, as explained more fully below.

The sonic velocity air-liquid fuel mixture passes from the throat zone 22 into the gradually diverging downstream zone 24 where the kinetic energy of the high velocity air and fuel is efficiently converted to static pressure. Such conversion enables the maintenance of sonic velocity air and fuel flow through the throat zone 22 over substantially the entire operating range of the engine. Thus, sonic velocity is achieved at the throat zone even at very low manifold vacuum levels.

The mass flow of air passing through the device 10 is primarily governed by the position of the movable slab 18 relative to the stationary slab 16. Movement of the slab 18 varies the cross-sectional area of the throat zone, and under sonic conditions such variation is accompanied by an equal variation in the mass flow of air. However, such equal mass flow of air is only achieved when the atmospheric conditions remain constant, as explained more fully below.

A rod 38 extending through an opening in the end plate 26 is secured to the outside surface of the movable slab 18. This rod is under the control of a throttle linkage (not shown), and the cross-sectional area of the throat zone is varied by moving the slab 18 in direct response to operating demands imposed upon the engine to which the device 10 is attached. Such demands are imposed upon the throttle linkage which in turn causes the rod to move slab 18 to vary the throat zone area. Since the fuel metering rod 36 is connected for movement with the slab 18 it is also under the direct control of the throttle linkage. The relationship between the metering rod 36 and the fuel opening 34 is such that incremental changes of the throat area are accompanied by proportional changes in the free cross-sectional area between the metering rod and the fuel opening. Hence, under sonic air flow and constant atmospheric conditions, when the area of the throat zone is varied such variation is accompanied by a directly proportional variation in the fuel delivered into the high velocity air stream. The air-to-fuel ratio of the mixture produced remains constant even though the demands of the engine change.

It is significant that the inside walls of the slabs 16, 18 are parallel to one another at least from the throat zone 22 to somewhat above the elevation of the fuel opening 34. By providing such a relationship, the ratio of the cross-sectional area at the fuel opening 34 relative to the area of the throat zone 22 remains constant. Changes in the area of the throat zone are accompanied by linearly related changes in the area of the air entrance zone 20 at the fuel opening 34. With such a constant area ratio, the pressure at the point of introduction of fuel into the air entrance zone 20 bears a predictable relationship to the pressure at the throat. As explained above, under sonic conditions, the pressure at the throat 22 is always approximately 53% of atmospheric pressure. Since the ratio of the area at the point of fuel introduction relative to the area at the throat zone 22 remains constant, the pressure at the fuel introduction point 34 in the air entrance zone 20 is always the same percentage of atmospheric pressure. Thus, changes in atmospheric pressure are automatically reflected in the pressure at the fuel introduction location 34.

It is desirable to produce a vacuum signal at the fuel introduction point of about 1″ Hg., and the point of fuel introduction is therefore located away from the throat at a position in the air entrance zone where about 1″ Hg. vacuum exists during sonic flow at the throat. Without a constant area ratio between the throat and the fuel introduction point, the vacuum signal at the fuel point would not vary directly with the throat opening and the only location of unvarying vacuum would be at the throat. Difficulty in precise location of the throat could result in a varying signal at this location.

In operation, the pressure of the high velocity air stream flowing through the passageway of the device 10 is sensed at the fuel opening 34 where it bears a predictable relationship to atmospheric pressure. The rate of fuel delivered into the air stream is adjusted in response to changes in the air pressure sensed so that the air-to-fuel ratio of the air-liquid fuel mixture is maintained substantially constant. Adjustment of the rate of fuel delivered into the air stream is accomplished by the change in pressure differential across the valve that comprises the tapered metering rod 36 and the fuel opening 34. For reasons noted above, the pressure of the air stream at the fuel opening 34 changes in proportion to atmospheric pressure variations, and the pressure change at the fuel opening results in a change in the pressure differential across the valve. The rate of fuel delivered into the air stream is thereby adjusted in direct response to changes in atmospheric pressure.

During the relatively brief subsonic mode of operation when the manifold vacuum levels are quite low, the fluid flow device functions as a metering venturi to introduce varying quantities of liquid fuel into the varying velocity air stream. Due to the efficient conversion of the energy of the high velocity air and fuel to static pressure in the diffuser, sonic air flow at the throat zone 22 is maintained over just about the entire operating range of the engine. However, at very low manifold vacuum levels of below 5″ Hg. vacuum, for example, the air flow at the throat zone 22 may drop below sonic and the reduced velocity operates to suck less fuel into the passageway. During the subsonic mode the vacuum signal at the fuel opening 34 varies as the air velocity squared.

FIGS. 8 and 9 illustrate an alternate embodiment 40 of the tapered fuel metering rod 36. Rod 40 includes a tapered slot having a decreasing cross-sectional area in the direction from the end of the rod inwardly along its length. As is clear from the drawing, movement of the slab member 18 to the right, as viewed in FIG. 1, causes the rod to move further into the opening 34, and the free cross-sectional area of the tapered slot 42 is thereby diminished an amount proportional to the decrease in throat area caused by such movement of the slab.

FIGS. 10 and 11 also show a variation of the fuel metering rods 36 and 40. In this regard, a fuel metering rod 44 includes a pair of tapered slots 46, and each of the slots 46 functions in a manner similar to tapered slot 42 as the rod 44 moves relative to a fuel opening such as opening 34.

Figure 12:
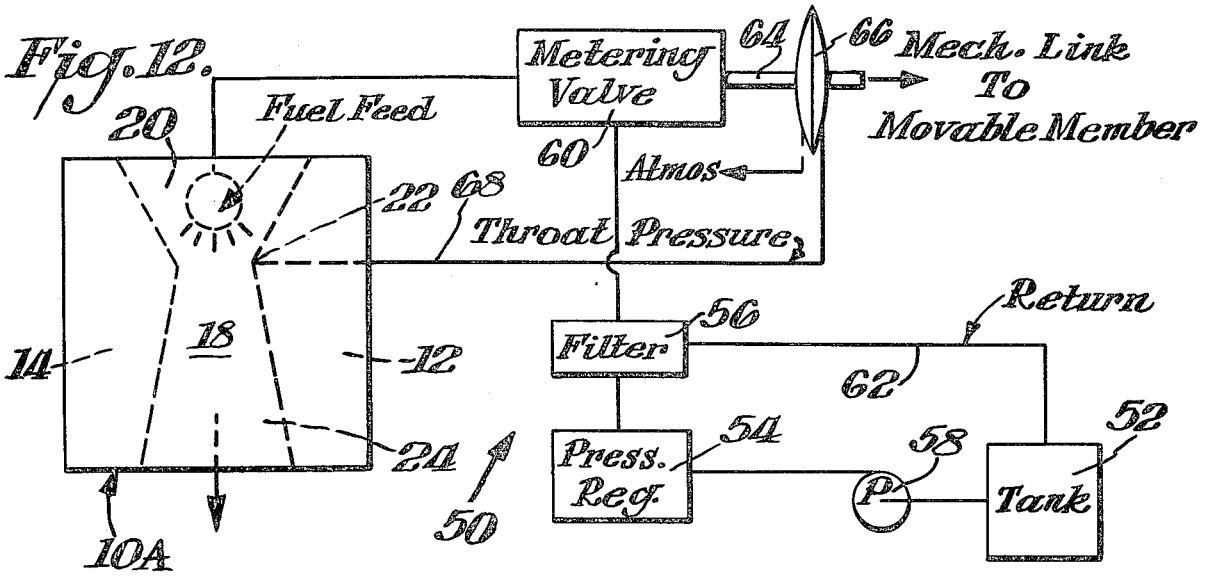
FIG. 12 is a schematic diagram of a liquid fuel metering arrangement, according to the present invention.

FIG. 12 illustrates an arrangement 60 for producing a combustible air-liquid fuel mixture having a constant air-to-fuel ratio over substantially the entire operating range of the engine to which the mixture is supplied. The overall arrangement includes a fluid flow device 10A similar to the device 10 of FIGS. 1–5 for mixing and modulating the fuel and air, but device 10A has a different liquid fuel metering system. Device 10A has opposite stationary large jaws 12, 14, and the cross-sectional area of the throat zone 22 is varied by moving the small parallel slab members toward and away from one another in the same manner as described above in conjunction with device 10. Fuel from a tank 52 is delivered to pressure regulator 54 and filter 56 by a pump 58. The fuel flows from the filter 56 to a metering valve 60 as it is needed and the surplus is returned to the tank 52 via a return line 62. The metering valve 60 is controlled by a stem 64 directly linked to the movable slab member 18 of the mixing and modulating device 10A. The metering valve is arranged to open when the valve stem is moved to the right, as viewed in FIG. 12. Also, as explained above, since movement of the metering valve 60 is directly linked to the movement of the slab member 18, the valve movements are proportional to the cross-sectional area of the throat zone 22.

A diaphragm or bellows 66 is connected in the valve stem 64 for modulating the position of the valve 60 in relation to variations in the pressure sensed at the throat 22. In this regard, the right side of the diaphragm or bellows 66 is exposed to the throat 22 via a line 68, and the other side of the diaphragm or bellows is vented to the atmosphere. As the diaphragm or bellows moves to the right or left depending upon fluctuations of the pressure sensed at the throat zone, the valve stem moves with the diaphragm or bellows to adjust the metering valve setting and thereby adjust the rate of fuel delivered into the air stream flowing through the device 10A.

In operation, when sonic air and fuel pass through the device 10A at the throat zone 22, the pressure sensed at the throat zone is always approximately 53% of atmospheric pressure. For example, when the atmospheric pressure drops, the air flowing through the device has less mass density and less fuel is therefore required in order to maintain a constant air-to-fuel ratio of the mixture produced. Since the pressure of the high velocity air stream at the throat 22 bears a predictable relationship to atmospheric pressure, the pressure sensed is therefore slightly lower by an amount proportional to the drop in atmospheric pressure. The incremental pressure drop sensed at the throat zone 22 and applied to the right side of the diaphragm or bellows 66 is less than the incremental drop in atmospheric pressure applied to the other side, and this pressure differential causes the diaphragm or bellows to move to the left to slightly close the valve 60 and thereby reduce the rate of fuel delivered into the air stream. Hence, the air-to-fuel ratio of the mixture produced by the device 10A remains substantially constant even though changes in atmospheric pressure vary the mass flow of air passing through the device.

When the air flow through the throat drops below sonic, the device 10A functions as a metering venturi to draw fuel into the air stream as the air velocity varies. However, as noted above, the subsonic mode of operation is quite brief due to the highly efficient conversion of velocity energy to static pressure in the diffuser zone 24.

Figure 13:
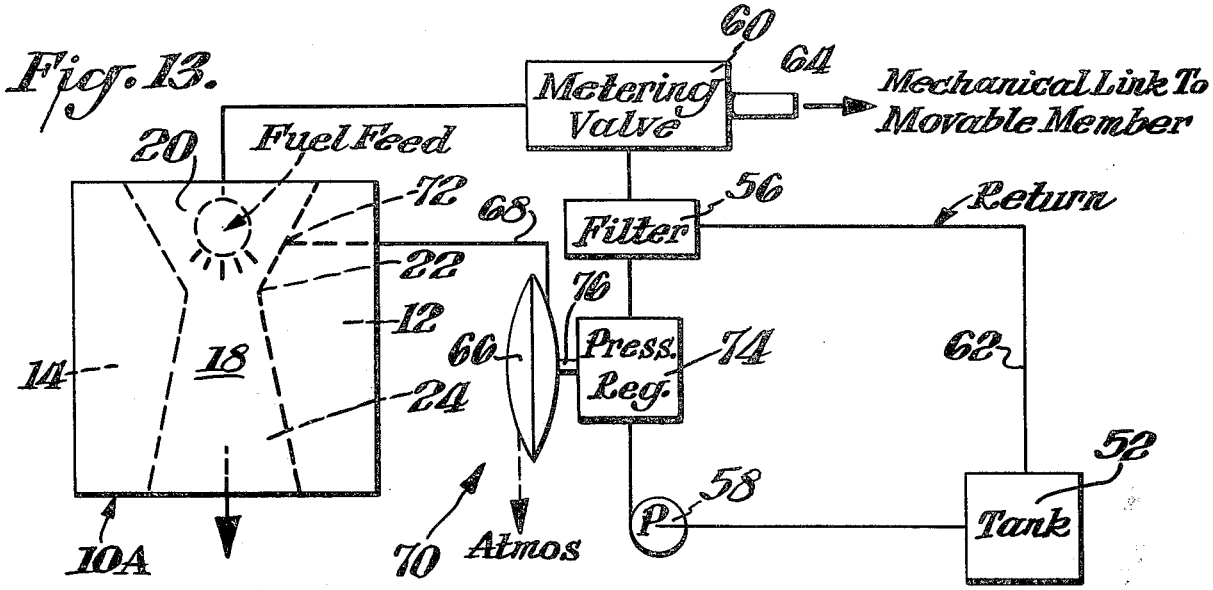
FIG. 13 is a schematic diagram of another liquid fuel metering arrangement, according to the present invention.

FIG. 13 shows another liquid fuel metering arrangement 70 according to the present invention. In many respects this arrangement is similar to the one shown in FIG. 12, and similar reference characters are used to identify similar parts. In the liquid fuel metering arrangement 70 the pressure of the high velocity air stream is sensed at a point 72 above the throat zone 22. However, for reasons discussed above in connection with FIGS. 1–5, the pressure of the air stream sensed at location 72 bears a predictable relationship to atmospheric pressure since the area ratio of the air entrance zone 20 at location 72 relative to the area of the throat 22 is constant.

The arrangement 70 includes an adjustable pressure regulator 74 which is varied depending upon changes in the pressure of the high velocity air stream. In this regard, when the stem 76 of the pressure regulator 74 is urged to the right, as viewed in FIG. 13, fuel is delivered to the metering valve 60 at a slightly higher pressure thereby causing the rate of fuel delivered into the air stream to increase. On the other hand, when the stem 76 is urged to the left, as shown in FIG. 13, the pressure on the fuel delivered to the metering valve is slightly decreased thereby causing a reduction of the rate of fuel delivered into the air stream. The stem 76 is connected to the diaphragm or bellows 66, the right side of which is exposed to the pressure of the air stream at location 72 and the other side of which is vented to the atmosphere.

Generally, the diaphragm or bellows 66 operates in the same manner as described above to modulate the position of the stem 76 connected to the pressure regulator 74. Such modulation either increases or decreases the pressure on the fuel delivered to the metering valve 60 to thereby adjust the rate of fuel delivered into the air stream in response to changes in the air pressure sensed at location 72 in the air entrance zone 20 of device 10A. Since the pressure sensed bears a predictable relationship to atmospheric pressure, adjustment of the fuel rate due to changes in pressure provide a mixture having a substantially constant air-to-fuel ratio.

Figure 14:
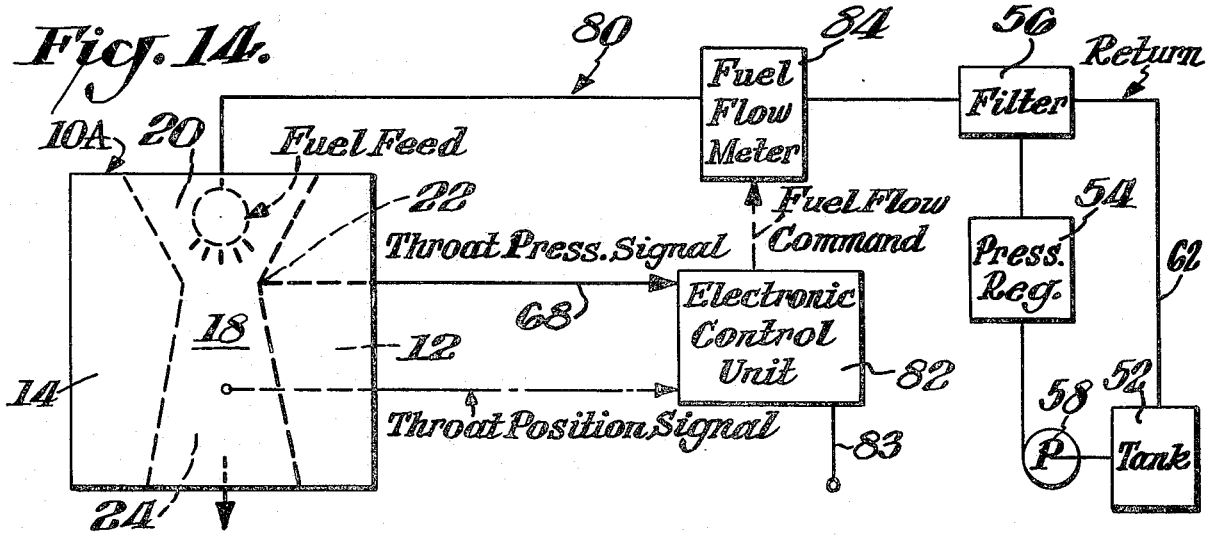
FIG. 14 is a schematic diagram of still another liquid fuel metering arrangement, according to the present invention.
Figure 15:
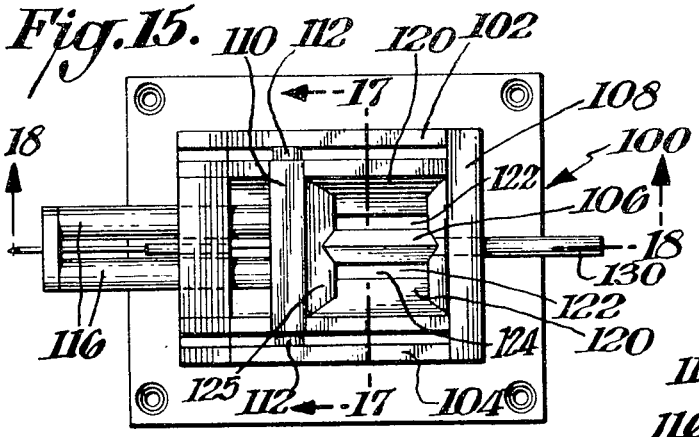
FIG. 15 is a top plan view of another fluid flow device, according to the present invention.
Figure 17:
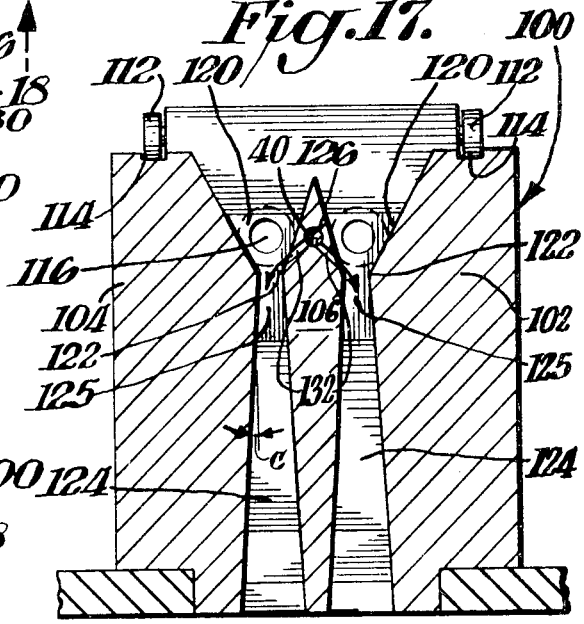
FIG. 17 is a sectional view taken along line 17—17 of FIG. 15.
Figure 16:
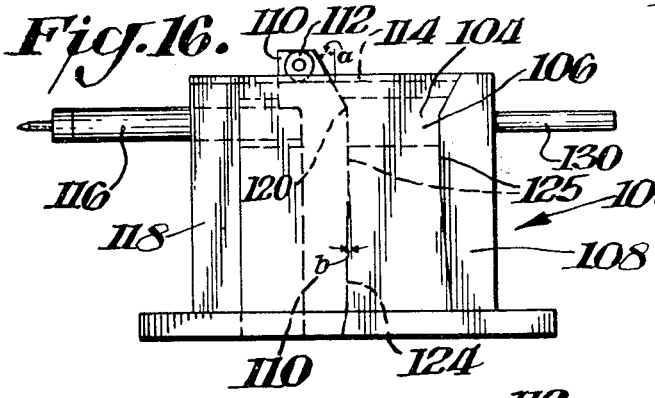
FIG. 16 is a side elevational view of the device shown in FIG. 15.
Figure 18:
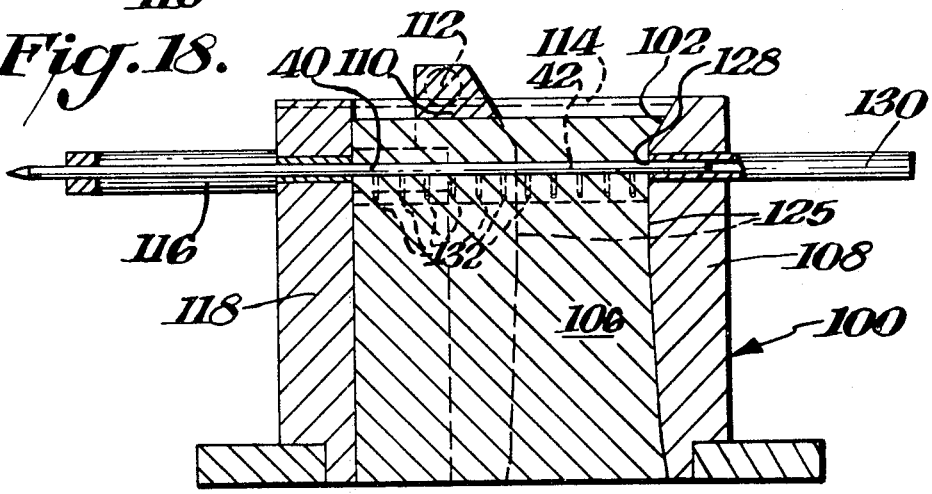
FIG. 18 is a sectional view taken along line 18—18 of FIG. 15.

FIG. 14 illustrates still another liquid fuel metering arrangement 80 according to the present invention. Many of the components of the arrangement 80 shown in FIG. 14 are similar to the components of arrangement 50 and 70, and similar reference characters are utilized to identify similar parts. Generally, an electronic control unit 82 receives a throat position signal depending upon the relative position of the movable slab member 18. For reasons explained above, this signal is directly proportional to the area of the throat zone 22. Fuel is then introduced into the air stream in direct proportion to the area of the throat zone 22, as represented by the throat position signal. Also, the electronic control unit 82 receives a throat pressure signal via line 68 connected at the throat 22. The throat pressure signal results from sensing the pressure of the high velocity air stream at the throat, and this signal varies in direct relation to variations in atmospheric pressure, as explained above. Finally, the electronic control unit 82 receives an atmospheric temperature signal via sensor 83 so that fuel metering may be adjusted for atmospheric temperature fluctuations, as explained below.

A fuel flow command is transmitted from the electronic control unit 82 to a fuel flow meter 84, and this command is solely dependent upon the cross-sectional area of the throat zone 22 when the atmospheric pressure and temperature remain constant. However, when atmospheric pressure increases, for example, the throat pressure signal transmitted to the electronic control unit 82 also increases by a proportional amount. The electronic control unit then transmits an increased fuel flow command to the meter 84 to increase the rate of fuel delivered to the air stream in direct proportion to the increase of the mass flow of air caused by the increase in atmospheric pressure. Likewise, when atmospheric temperature increases, for example, the signal transmitted from control unit 82 to meter 84 is reduced. The air-to-fuel ratio of the mixture produced by the device 10A is therefore maintained substantially constant even though atmospheric conditions change.

In the fuel metering arrangement 80, the fluid flow device 10A functions as a metering venturi during the brief subsonic mode of operation but in a slightly different manner. Here, the reduced throat pressure signal is transmitted to the control unit 82 which in turn transmits a reduced fuel flow command to the meter 84 to decrease the rate of fuel delivered.

FIGS. 15–18 illustrate a fluid flow device 100 for mixing and modulating air and fuel in a manner similar to that described in conjunction with the device of FIGS. 1–5. However, unlike device 10 the mixing and modulating device 100 is a two-barrel version wherein liquid fuel and air are mixed and modulated in two separate internal passageways. Specifically, the device 100 includes spaced apart opposite stationary large jaws 102, 104 with a stationary partition wall 106 positioned between the jaws and equally spaced therefrom. A fixed small member 108 further defines the flow passageways, and a movable small member 110 is mounted for travel toward and away from the fixed member 108 to modulate the flow of air through the device. The movable member 110 includes rollers 112 that ride in tracks 114 on the top surface of the jaws 102, 104. An operator rod 116 extends through a suitable opening in support wall 118 and is attached to the movable member 110. The rod 116 functions in the same manner as the rod 38 of device 10. Also, each of the flow passageways of the device 100 includes an air entrance zone 120, a variable area throat zone 122 and a gradually diverging zone 124. Each of these zones functions in the same manner as the zones 20, 22 and 24 of device 10.

As shown in the drawing, the relatively movable small members 108, 110 are in the form of small jaws in relation to the large stationary jaws 102, 104. Also, as shown best in FIGS. 16 and 18, each of the small jaws has an angle of convergence *a* in the upper portion of the air entrance zone 120, a flat portion 125 extending therefrom to slightly below the throat zone 122, and a slight angle of divergence *b* in the lower portion of the diffuser zone 124. The flat portions 125 provide a constant cross-sectional area relationship in that segment of the flow passageways, as explained more fully below. Moreover, in connection with the slight angle of divergence of the small jaws 108, 110 in the diffuser zone 124, such divergence is provided to prevent the diffuser zone from acting like a choke under low flow conditions. In this regard, the smaller jaws 108, 110 dominate the influence of the stationary larger jaws 102, 104 as the cross-sectional area of the throat zone 122 is reduced. Hence, without a slight angle of divergence on the small jaws in the lower portion of the diffuser zone, the diffuser would look increasingly like a choke as less of each large jaw was exposed. Preferably, each of the small jaws has an angle *b* of about 0° to 2° in the diffuser zone 124. The angle of divergence *c* of each of the large jaws in the diffuser zone is about 2° to 5°, as shown best in FIG. 17.

The partition wall 106 includes an internal transverse bore 126 upstream from the throat zones 122 and parallel to the cross-sectional areas thereof. The bore is arranged to slidably receive a fuel metering rod 40, and the rod is connected for travel with the movable small jaw member 110 in the same manner described above. The free end of the metering rod is received within a fuel opening 128 connected by line 130 to a fuel supply (not shown). The tapered slot 42 of the rod cooperates with the fuel opening 128 to vary the rate of fuel introduced into the air entrance zone 120 as the movable jaw 110 varies the area of each throat zone 122. Specifically, fuel flows out of the opening 128 into the bore 126 and then into a series of fuel ports 132 that extend to the air entrance zone 120 of each passageway.

In operation, the movable small jaw 110 varies the area of each throat zone 122 in response to demands imposed upon the engine to which the air-fuel mixture is supplied. Such movement is accomplished in the same manner as described above in connection with device 10 of FIGS. 1–5. Also, such movement causes the fuel metering rod 40 to move relative to the fuel opening 128 to change the rate of fuel introduced into the high velocity air streams in direction proportion to the overall throat area. Hence, when the air flow is sonic at the throats 122 and atmospheric pressure remains constant, the air-to-fuel ratio of the mixture produced by the device 100 also remains constant since changes in air flow are accompanied by proportional changes in the fuel introduced into the air. For example, when the atmospheric pressure is 30 inches Hg. and the pressure at the fuel introduction point is 29 inches Hg. the pressure differential across the valve comprising the rod 40 and opening 128 remains constant at 1.0 inches Hg. regardless of the throat opening during the sonic mode.

On the other hand, when the atmospheric pressure changes, the mass flow of air for any given combined throat area also changes, and the rate of fuel delivered into the air must be adjusted in order to maintain a constant air-to-fuel mixture. As explained above, the surfaces of the small jaws 108, 110 include flat parallel portions 125 which extend from each throat zone upwardly to at least the point of introduction of the fuel into the air entrance zone 120. By providing such flat parallel wall portions 125 the cross-sectional area of the air entrance zone at the point of fuel introduction relative to the area of the throat zone remains constant. Hence, the pressure sensed at the point of fuel introduction bears a predictable relationship to atmospheric pressure, for reasons explained above. Therefore, when the atmospheric pressure decreases, for example, the pressure of the air stream at the point of fuel introduction also decreases by a proportional amount. The pressure differential across the valve comprising the metering rod 40 and the fuel opening 128 likewise decreases and such decrease causes less fuel to be delivered into the air streams. This pressure compensating feature provides an air-fuel mixture having a substantially constant air-to-fuel ratio regardless of changes in atmospheric pressure. Hence, for example, when the atmospheric pressure drops to 24 inches Hg., the pressure at the fuel introduction point drops to 23.2 inches Hg. The pressure differential across the valve drops to 0.8 inches Hg. and less fuel is drawn into the less dense air stream.

Further, when the air flow at the throat zones 122 drops below sonic velocity, the device 100 functions as a metering venturi during this rather brief operating mode. Fuel is drawn into the passageway in relation to the velocity of air, as explained in detail above in conjunction with the other embodiments of the invention.

The particular geometry of the device 100 provides the air flow rates necessary for operating a wide range of internal combustion engines for automobile use. The diffuser zone characteristics explained above enable highly efficient conversion of velocity energy to static pressure whereby sonic velocity is maintained over substantially the entire operating range of the engine to which the produced air-liquid fuel mixture is supplied. Also, it is preferred that the cross-sectional area ratio of the downstream end of each diffuser zone 124 relative to each throat zone 122 be approximately 1.3 to 20:1, preferably 1.5 to 15:1. The above geometric relationships often require that plural passageways be provided in order to produce an air-liquid fuel mixture at the rate demanded by the engine. Hence, rather than alter these characteristics in the construction of a single enlarged passageway, multiple passageways are preferred.

Also, the ratios discussed above provide a device which is relatively insensitive during the critical idling mode of the engine. When such ratios are maintained, the area of the throat zone is easily varied in very small increments since the small jaws 108, 110 move relative to one another while the large jaws 102, 104 remain stationary. Significant movements of the small jaws provide less significant change in the area of the throat zone as compared to a device where the larger jaws move and the small jaws are stationary.

Figure 19:
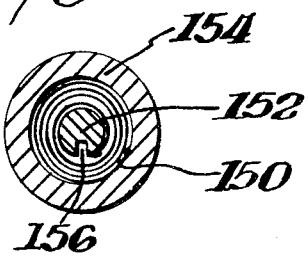
FIG. 19 is a partial sectional view illustrating a temperature responsive metering rod arrangement, according to the present invention.
Figures 20, 21, 22:
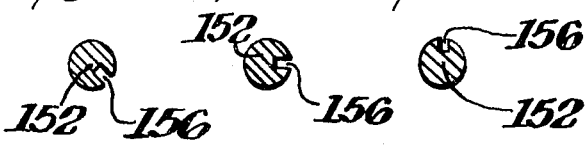
FIGS. 20–22 are cross-sectional views of the rod at various temperature compensated positions.

FIGS. 19–22 illustrate an arrangement for adjusting the rate of fuel delivered into a high velocity air stream in response to temperature fluctuations of the incoming air. Such adjustment is provided in order to produce an air-liquid fuel mixture having a substantially constant air-to-fuel ratio. As shown in FIG. 19, a bimetallic element 150 is connected between a rotatably mounted fuel metering rod 152 and a housing 154 that reciprocates with the rod as the fuel flow is modulated. The fuel metering rod 152 is of the type that includes a single tapered slot 156, and as the rod moves into and out of a suitable fuel opening, the rate of fuel delivered into a high velocity air stream is modulated in the same manner as described above.

The structure of FIGS. 19–22 has the added feature of changing the position of the tapered slot 156 relative to the throat zone when the incoming air temperature changes. By rotating the rod 152, the portion of the tapered slot 156 at the fuel opening is subjected to slight pressure differences, and these differences alter the pressure drop across the fuel valve comprising the metering rod 152 and its associated fuel opening. For example, when the temperature of the incoming air increases it is desirable to slightly reduce the rate of fuel delivered into the higher temperature air stream in order to maintain a substantially constant air-to-fuel ratio. The bimetallic element 150 senses the temperature increase and causes the metering rod 152 to slightly rotate in a counterclockwise direction, for example, from the position of FIG. 20 to the position of either FIG. 21 or 22. Such rotation subjects the portion of the tapered slot 156 at the fuel opening to a slight increase in pressure which reduces the pressure drop across the valve and causes less fuel to flow. Thus, although the temperature increase of the incoming air reduces the mass flow of air, the rate of fuel introduced is adjusted to compensate for the temperature rise.

The arrangement of FIGS. 19–22 is particularly useful with the fluid flow device of FIGS. 1–5. Temperature compensation may also be accomplished with the device of either FIGS. 1–5 or FIGS. 15–18 by shifting the metering rod relative to the fuel openings in response to temperature fluctuations. In this regard, a bimetallic element may be used to slightly urge the rod into the opening when the atmospheric temperature rises and to withdraw the rod away from the opening when the temperature decreases, for example.

What is claimed is:

1. A method for producing a combustible air-liquid fuel mixture having a substantially constant air-to-fuel ratio comprising the steps of passing air through a variable area throat zone to increase its velocity to sonic, varying the area of the throat zone in correlation with operating demands imposed upon the engine for which the mixture is produced, metering fuel from a supply into the air stream at or before the throat zone in direct proportion to the area thereof, sensing the pressure of the high velocity air stream at a point before the throat zone where the cross-sectional area ratio between the variable area throat zone and the plane of the pressure sensing point is constant, and adjusting the rate of fuel delivered into the air stream in response to changes in the air pressure sensed whereby the air-to-fuel ratio of the mixture is maintained substantially constant.

2. A method as in claim 1 including the steps of independently sensing atmospheric temperature and adjusting the rate of fuel delivered into the air stream in response to changes in the temperature sensed.

3. A method as in claim 1 wherein the pressure of the high velocity air stream is sensed at the point of introduction of fuel into the air stream.

4. A method as in claim 3 wherein the pressure of the high velocity air stream at the point of introduction of fuel into the air stream is about 29 inches Hg. when the atmospheric pressure is 30 inches Hg.

5. A device for producing a combustible air-liquid fuel mixture having a substantially constant air-to-fuel ratio over substantially the entire operating range of an engine to which the mixture is supplied comprising wall means defining a passageway including a gradually converging air entrance zone, a variable area throat zone through which air and liquid fuel are passed at sonic velocity, and a gradually diverging downstream zone, fuel supply means, fuel delivery means for introducing fuel into the passageway at or above the throat zone at a rate directly proportional to the area of the throat zone, pressure sensing means constructed and arranged to sense the pressure of the high velocity air stream at a point in the air entrance zone where the cross-sectional area ration between the variable area throat zone and the plane of the pressure sensing point is constant, and means applying the pressure sensed by the pressure sensing means to the fuel delivery means to adjust the fuel rate in response to changes in the pressure determined by the sensing means whereby the air-to-fuel ratio of the mixture is maintained substantially constant.

6. A device as in claim 5 including independent temperature sensing means for sensing atmospheric temperature, and means adjusting the fuel rate in response to changes in atmospheric temperature.

7. A device as in claim 5 wherein the wall means comprises a pair of spaced apart opposite stationary large jaws and a pair of opposite small members mounted for relative movement toward and away from one another to thereby vary the area of the throat zone, and wherein the fuel delivery means includes a fuel opening in one of the small members upstream from the throat zone connected to the fuel supply, and a fuel metering rod connected for movement with the other small members received within the fuel opening whereby as the area of the throat zone is varied by relative movement of the small members the metering rod moves relative to the fuel opening to vary the cross-sectional area of the opening in direct proportion to the area of the throat zone.

8. A device as in claim 7 wherein the small members are in the form of small jaws each having an angle of convergence in the upper portion of the air entrance zone, a flat portion extending therefrom to slightly below the throat zone, and a slight angle of divergence in the lower portion of the diffuser zone.

9. A device as in claim 7 wherein the small members are in the form of slabs.

10. A device as in claim 7 wherein the pressure of the high velocity air stream is sensed at the fuel opening.

11. A device as in claim 10 wherein the pressure of the high velocity air stream at the point of introduction of fuel into the air stream is about 29 inches Hg. when the atmospheric pressure is 30 inches Hg.

12. A fluid flow device for producing a combustible air-liquid fuel mixture comprising wall means defining at least one passageway including a gradually converging air entrance zone, a variable area throat zone through which air and liquid fuel are passed sonic velocity, and a gradually diverging downstream zone, the wall means including a pair of spaced apart opposite stationary large jaws and a pair of opposite small jaws mounted for relative movement toward and away from one another to vary the area of the throat zone, the opposite small jaws each having an angle of convergence in the upper portion of the air entrance zone, a flat portion extending therefrom to slightly below the throat zone, and a slight angle of divergence in the lower portion of the diffuser zone, fuel supply means, and fuel delivery means for introducing fuel into the passageway at or above the throat zone where the small jaws are flat.

13. A device as in claim 12 wherein the cross-sectional area ratio of the downstream end of the diffuser to the throat zone is approximately 1.3 to 20:1.

14. A device as in claim 12 wherein each of the large stationary jaws has an angle of divergence approximately 2° to 5° in the diffuser zone and each of the small jaws has an angle of divergence approximately 0° to 2° in the diffuser zone.

15. A device as in claim 14 wherein the cross-sectional area ratio of the downstream end of the diffuser to the throat zone is approximately 1.5 to 15:1.

* * * * *